United States Patent [19]

Sobczak

[11] 3,942,145

[45] Mar. 2, 1976

[54] SNAP-ACTION SWITCH

[75] Inventor: Bernard J. Sobczak, Chicago, Ill.

[73] Assignee: Teletype Corporation, Skokie, Ill.

[22] Filed: Sept. 3, 1974

[21] Appl. No.: 502,489

[52] U.S. Cl. ..... 335/188; 335/206; 200/67 F

[51] Int. Cl.[2] ..... H01H 5/00

[58] Field of Search ..... 335/188, 206, 205, 207; 200/67 F

[56] References Cited

UNITED STATES PATENTS

| | | | |
|---|---|---|---|
| 3,175,060 | 3/1965 | Crissinger et al. | 335/188 X |
| 3,376,527 | 4/1968 | Risk | 335/207 |
| 3,458,841 | 7/1969 | Davis | 335/207 |
| 3,815,066 | 6/1974 | Vinal | 335/207 X |

*Primary Examiner*—G. Harris

*Attorney, Agent, or Firm*—J. D. Kaufmann; J. L. Landis

[57] ABSTRACT

A snap-action switch moves a spring-biased, movable contact against a stationary contact. The switch includes a toroidal permanent magnet mounted loosely on a nonmagnetic, self lubricating plunger. The magnet is normally magnetically attracted to and adjacent to both a keeper and an armature, the armature being fixed to the plunger. The plunger slides through the keeper which also mounts the switch to a keyboard. A finger-engageable button is moved toward the keyboard to store sufficient potential energy in a spring to move the plunger and suddenly break the magnetic attraction, thereby providing a tactile snap-action. Plunger movement moves the movable contact in spring-versus-spring fashion until the contacts engage. Facilities are provided to minimize contact bounce, to maintain the magnet in a preferred position during plunger movement, to ensure self-aligning of the magnet with the keeper and the armature, to minimize contact damage and to optimize the tactile "feel" of the switch.

15 Claims, 5 Drawing Figures

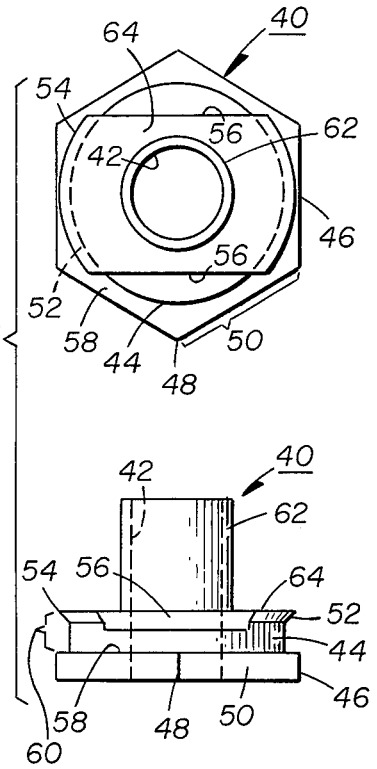
FIG. 3
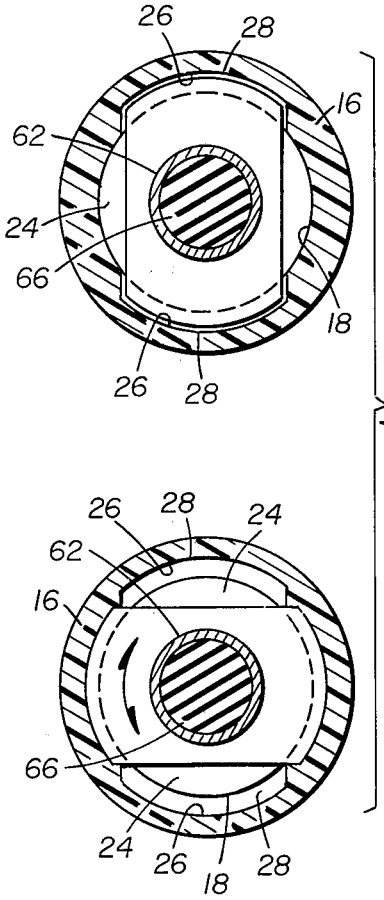
FIG. 4
FIG. 5
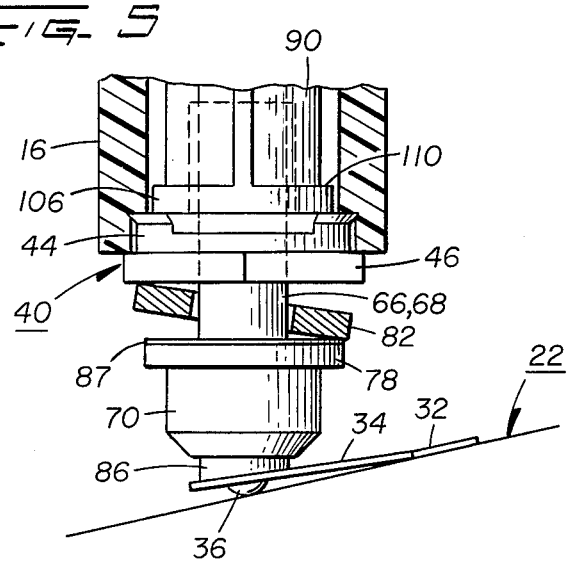

SNAP-ACTION SWITCH

INTRODUCTION AND BACKGROUND

This invention relates to an electrical switch and more particularly to a finger-operated, snap-action switch of the type usable in and mounted to a keyboard of a typewriter or a teleprinter.

The wide variety of keyboard-mounted switches found in present day printers and typewriters are well known. Often such switches are somewhat complex and are not easily assembled. Such complexity adds to the cost of the unit in which the switches are placed and creates problems during repair or replacement. Accordingly, one object of the present invention is the provision of an electrical switch simpler than those currently in use which is easy to manufacture, easy to assemble, and which exhibits high reliability.

A typical prior art keyboard switch often includes a plunger which slides in response to the application of finger force thereto. The sliding of the plunger ultimately affects the operation of some sort of circuit energization facility, such as causing the engagement of a pair of electrical contacts or altering the capacitance between two members by moving them relatively to each other. One difficulty with many types of prior art switches is that they lack so-called tactile feedback. Specifically, the plungers in many such switches slide in a smooth uniterrupted motion in such a manner that the operator is hard put to tell whether or not operation of the circuit energization (facility) has taken place. Usually such operation has in fact, taken place, but it has been found that there is a psychological need on the part of an operator to have some sort of tactile feedback at the fingertips indicating this condition. Switches for providing such tactile feedback are often referred to as "snap-action" switches. Accordingly, another object of this invention is to provide a snap-action switch which generates efficient tactile feedback to the operator.

In many prior art keyboard switches, it is possible that the full finger force applied to the plugner via a finger-engageable key may ultimately be applied to the electrical contacts or the capacitive members which are operated by the plunger. This is often damaging to the contacts or members, or at least increases the possibility of failure in a short time. Accordingly, another object of the present invention is to provide a snap-action electrical switch for use in a keyboard, which is designed in such a manner that the full application of finger force to the contacts or capacitive is effectively prevented.

Also, the prior art contains references to numerous electrical switches in which the snap-action is derived from the use of a magnet or magnets. Specifically, the force applied to the key and thus to the plunger must exceed the magnetic attraction between the magnet and a movable armature before the plunger will move. The sudden breaking away of the armature from the magnet is what provides the so-called snap-action in the switches. However, many prior art devices are overly complicated as to the relationship of the magnet to other parts of the switch. Moreover, in assembly and use of such switches, precise alignment and positioning techniques must often be utilized to render them properly operative. Thus, another object of the present invention is to provide a magnetic, snap-action, electrical switch for use in a keyboard, which is easy to assembly, which is reliable, and which avoids the complication of the prior art by providing for a convenient and efficient association of the parts thereof in a single, durable unit.

SUMMARY OF THE INVENTION

The above and other objects are effected, and the difficulties of the prior art are avoided, by the finger-operated, snap-action switch of the present invention.

The switch is preferably of a type which "makes" an electrical circuit; for example, by moving together ("closing") two contacts, one of which is stationary and one of which is movable toward and away from a stationary contact. Usually, the movable contact is biased to a normal position spaced from the stationary contact by a leaf spring or similar resilient member. However, the present invention may also be utilized with facilities which affect the operation of an electrical circuit by techniques other than contact closure. For example, the switch may relatively more capacitive members. Such movement changes the capacitance of the members and affects an electrical circuit in some manner. In this latter event, the member moved by the present switch is preferably spring-biased similar to the contact closure scheme.

A ferromagnetic torus serving as both a switch mount and a magnetic keeper has facilities thereon for convenient, rapid assembly into a keyboard. Specifically, the torus is mounted by inserting it into a complementary shaped hole in the keyboard and then turning the torus, driving a flange thereof into the wall of the hole to positively lock the torus therein.

A non-magnetic, self-lubricating plunger extends slideably through the torus and extends beyond both sides thereof. The plunger is preferably made of graphite in a binder or of a binder containing a low friction polymeric material. A first end of the plunger abuts, or is closely spaced from, the movable electrical contact. Attached to the plunger near the movable contact is a toroidal ferromagnetic armature, and between the armature and the torus is a toroidal permanent magnet which is freely slideable on the plunger and which normally interfaces with both the torus and the armature due to the magnetic attraction therebetween. Preferably, the magnet is of a type that contains numerous North and South poles distributed over the faces thereof, although the magnet may also have a discrete North and a discrete South pole defined on opposing faces. Both the spring-bias of the leaf spring associated with the movable contact and the magnetic attraction between the magnet and the torus as well as the magnet and the armature maintain the plunger in a normally, unoperated position whereat the contacts are not engaged.

A hollow cylinder closed at one end on which is a finger-engagable button has its open end slideably fitted over the second end of the plunger. The cylinder is journalled for sliding movement within the keyboard, the extent of its travel toward the keyboard due to finger pressure thereon being limited by the engagement of a lower end thereof with the torus. Contained within the cylinder and maintained between its closed end and the top of the plunger are one or more coil springs.

Downward movement of the cylinder due to the application of finger force to the button compresses the coil spring or springs. Continued movement continues to compress the spring(s) until the potential energy stored therein is sufficient to break the interface between the magnet and either the torus or the armature or both. At this time the plunger moves toward the fixed contact, carrying with it the movable contact, until the two contacts engage. Continued downward movement of the plunger ultimately results in engagement of the lower end of the cylinder with the torus. Because the only mechanical coupling between the cylinder and the plunger is the coil spring(s), full finger-force is never exerted against the electrical contact, but is rather borne by the torus and the surrounding portion of the keyboard in which the torus is mounted.

Upon release of finger pressure from the button, the spring force of the leaf spring on the plunger via the movable contact and the magnetic attraction of the magnet for the torus and the armature coact to return the plunger to its normal position. Simultaneously, the cylinder and the button are returned to their normal positions by the coil spring(s) acting against the plunger and the cylinder.

Facilities may be provided at the end of the plunger which engage the movable contact to reduce contact bounce. Such facilities may comprise a resilient or foam rubber bumper.

Facilities may also be provided for maintaining the magnet in a preferred position during rod movement. Such facilities may comprise a non-magnetic washer made of plastic or the like. The washer may be interposed at either the magnet/torus or magnet/armature interface, preferably the latter. This interposition provides a "built-in" gap at the selected interface so that the magnetic attraction thereat is less than the magnetic attraction at the other interface.

Also, the central hole of the magnet may be made sufficiently larger than the diameter of the plunger so that the magnet will self-align itself to flatly engage the surfaces of the torus and the armature.

DRAWINGS

FIG. 3 depicts a ferromagnetic toroid used as a magnetic keeper and for mounting the switch of FIG. 1 into the keyboard, wherein FIG. 3A is a top view of the toroid and FIG. 3B is a side elevation depicting in detail the features which enable easy and convenient assembly thereof with the keyboard;

FIG. 4 is a partial sectional view taken along the 4—4 of FIG. 1, which depicts the manner of assembling the torus of FIG. 3 with the keyboard of a teleprinter or typewriter viewed from the bottom of the torus, wherein FIG. 4A depicts an initial mounting step and FIG. 4B shows the manner in which the toroid is locked and mounted to the keyboard;

FIG. 5 depicts a portion of the switch of FIG. 1 during one possible mode of operation thereof.

DETAILED DESCRIPTION

Figure 1:
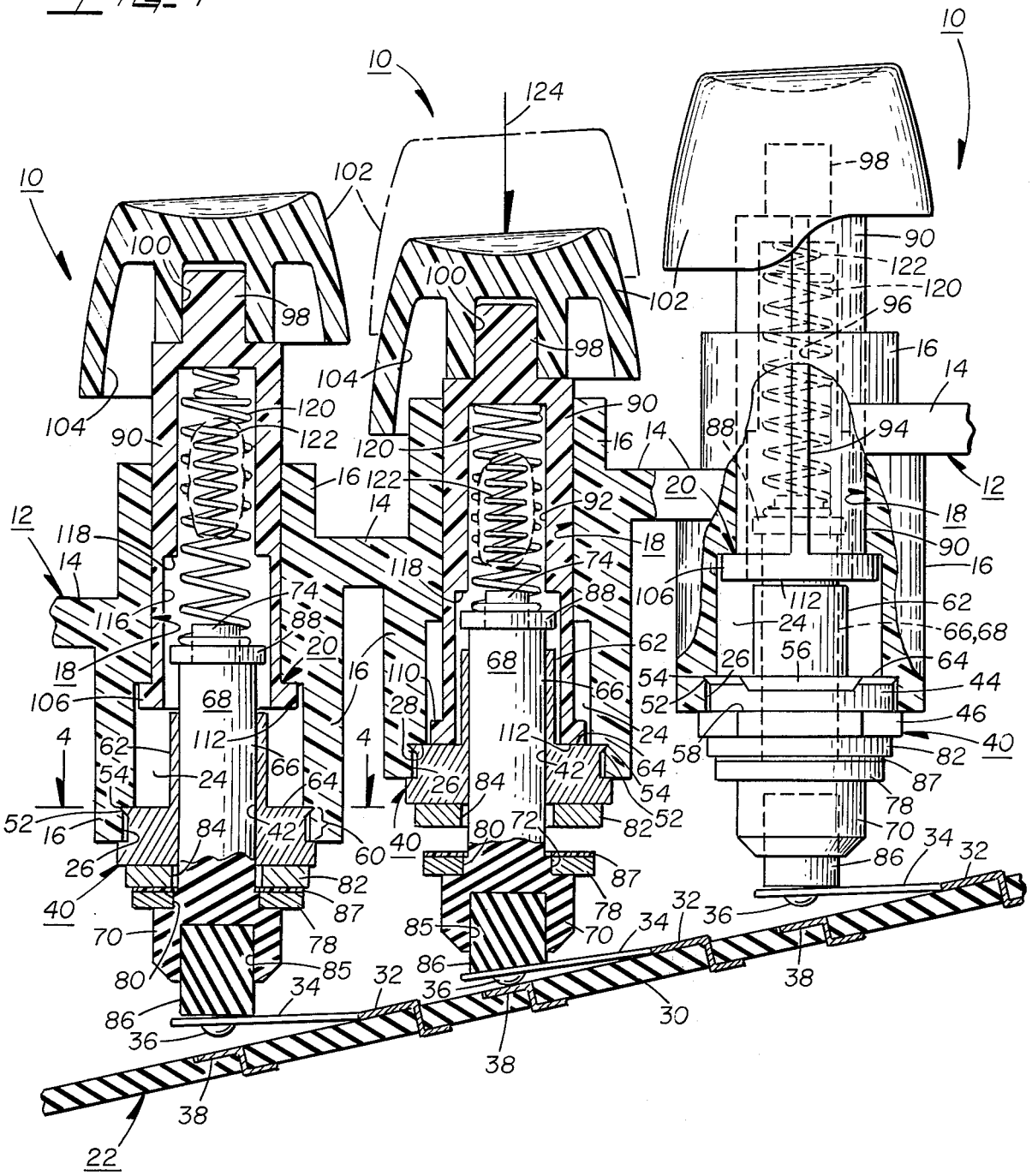
FIG. 1 is a partial sectional elevation of three electrical switches according to the present invention showing switches in both operated and unoperated positions, and showing the relationship of the switch to electrical contacts and a keyboard of a teleprinter or a typewriter.

Turning first to FIG. 1, there are shown three switches 10 according to the present invention, all mounted in a keyboard 12 of a teleprinter or typewriter. The facilities with which the switch 10 is usable may be other than a teleprinter or typewriter and such as is accordingly contemplated.

The keyboard 12 may be a thick, solid member or may, for purposes of saving material, take the shape shown in FIG. 1. Specifically, the keyboard 12 includes stepped, generally horizontal portions 14 and stepped, generally vertical portions 16, the latter containing bores 18 therethrough for mounting of the switches 10 therein. In the described embodiment, the bore 18 contains a step 20 for a purpose described below. Moreover, as best shown in FIGS. 1 and 4, the lower end of the bore 18 immediately adjacent a printed circuit board 22, or a similar wiring panel, defines a generally round enlarged opening 24 larger than the bore 18. A portion of the periphery of the opening 24 is further enlarged as shown at 26 so that a lip 28 is defined above the enlargement 26.

The printed circuit board 22 may include an insulative substrate 30 containing printed circuit paths 32 thereon. The paths 32 are connected to an electrical circuit (not shown) for effecting logic or other electrical functions in a teleprinter or typewriter. Some of the paths 32 are terminated in a leaf spring-like manner 34 which carries on a terminus thereof a bump-like electrical contact 36. The contact 36 is movable upon movement of the spring 34. Aligned with the path of movement of the movable contact 36 is a stationary contact 38 which may be attached to the printer circuit board 22 after its usual manufacture, or which may comprise a printed circuit path formed at the same time as the other printed circuit paths 32 on the board 22. Movement of the movable contact 36 toward the stationary contact 38 to effect engagement completes, makes, or affects the electrical circuit (not shown) in any well known manner. The switch 10 of the described embodiment is designed to effect engagement of the contacts 36 and 38.

As noted, devices other than the engageable contacts 36 and 38 may be used. For example, the contacts 36 and 38 may be replaced by the plates of a movable plate capacitor as shown in U.S. Pat. No. 3,671,822 issued on 6/20/72 and assigned to the same assignee as the present invention. In this case, movement of the plate replacing the movable contact 36 alters the capacitance of the capacitor, thus affecting the operation of an electrical circuit (not shown). Other types of contacts may obviously be substituted for the contacts 36 and 38 shown, the presence of the spring 34 on the movable member, however, being preferred.

Turning now to FIGS. 1 and 3, the switch 10 includes a mounting member 40 which also serves as a magnetic keeper. Preferably the member 40 is made of a ferromagnetic material. As shown in detail in FIG. 3, the member 40 is generally toroidal in shape and contains an interior bore 42 passing entirely therethrough. An intermediate portion 44 of the member 40 is positioned immediately above a lower portion 46, the outer periphery of which is hexagonal as shown in FIG. 3A. Both the apexes 48 and the sides 50 of the portion 46 extend outwardly from the center of the bore 42 farther than the outer side wall of the intermediate portion 44 as best shown in FIGS. 3A and 3B.

As viewed in FIG. 3B, at the top of the portion 44 there is formed into an outwardly slanting surface 52 which begins at the outer periphery of the portion 44 and terminates in a sharp edge 54. As best shown in FIG. 3A, neither the slanting surface 52 nor the edge 54 form a complete toroidal or circular shape. Rather, a vertical surface 56 is formed, as by machining, into what would otherwise be the slanting surface 52.

As best seen in FIG. 3B, the slanting surface 52 and the edge 54 on the one hand, and the upper surface 58 of the portion 46, define therebetween a gap 60, the purpose of which is described below. Surmounting the intermediate portion 44 and the slanted surface 52 is a tubular guide portion 62.

Turning now to FIG. 4, the manner in which the member 40 of FIG. 3 is associated with the keyboard 12 of FIG. 1 is depicted. As best seen in FIG. 4A, the shape of the opening 24 and of the enlargement thereof 26 is complementary to the shape of the intermediate portion 44 and, s viewed from the bottom, to the shape of the slanting surface 52 and the edge 54 with the vertical surface 56 therein. Specifically, as viewed from the bottom of the keyboard 12, the tubular member 62 is inserted into the opening 24 until a top surface 64 of the portion 44 above the edge 54 engages the lip 28 in the opening 24. The member 40 is now rotated to the position shown in FIG. 4B thus driving and staking the edge 54 into the side wall of the opening 24. This staking operation captures the side wall in the gap 60 between the staked edge 54 and the upper surface 58 of the portion 46 which engages the bottom of the vertical member 16. Such capturing may be best seen in FIG. 1. The turning of the member 40 may be conveniently accomplished by means of a socket tool or other type of driver (not shown) which engages the hexagonal portion 46.

Figure 2:
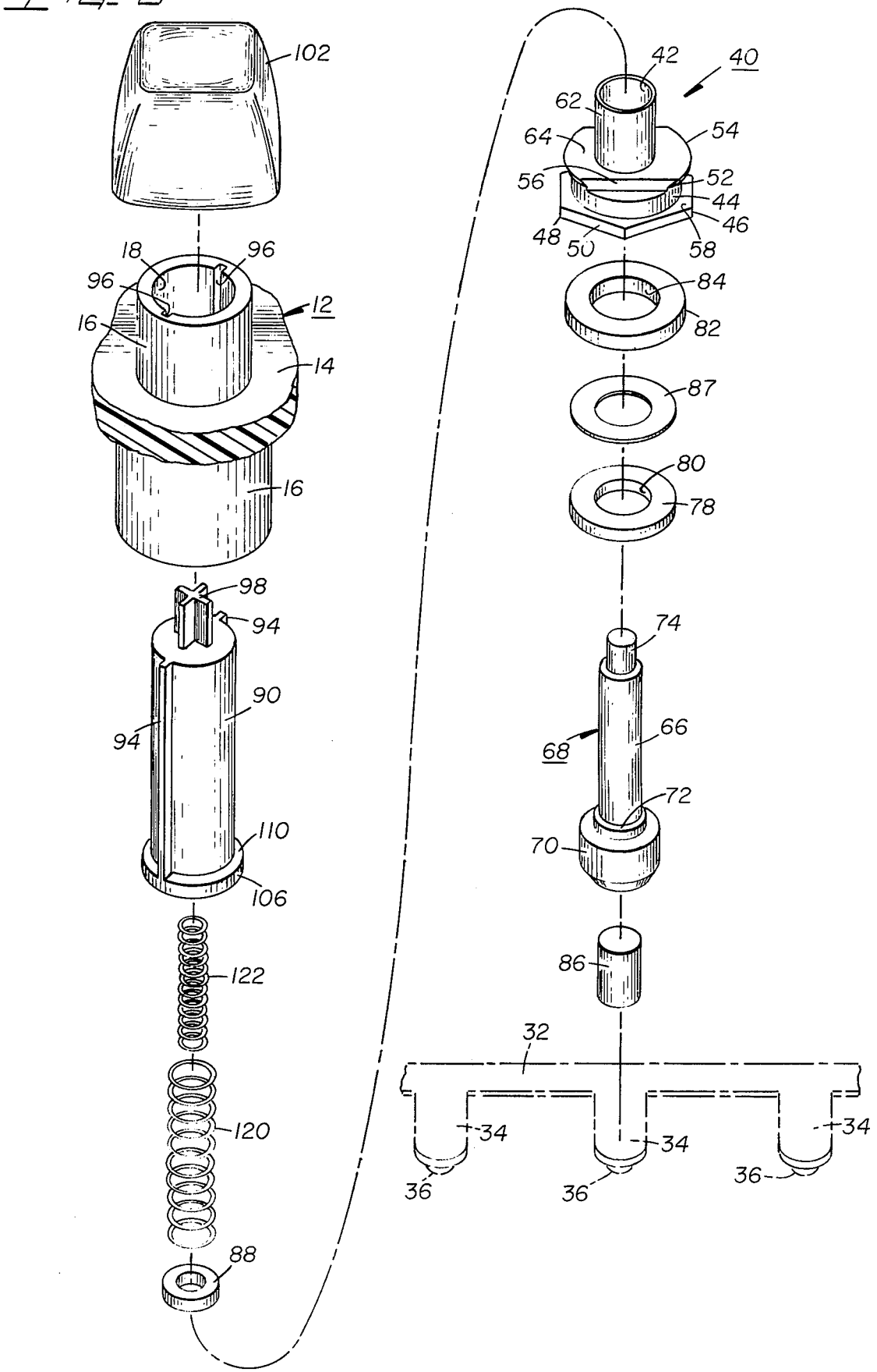
FIG. 2 is an assembly-type drawing of the component parts of one of the electrical switches of FIG. 1, showing the spatial relationship between the parts and a convenient mode of assembly thereof.

Returning to FIG. 1 and referring also to FIG. 2, the remainder of the switch 10 is described.

The mounting member 40 carries, within the bore 42 thereof, an upper elongated shaft 66 of a non-magnetic plunger 68. Preferably, the plunger 68 is fabricated of a self-lubricating non-magnetic material such as graphite, a graphite-containing binder or a low friction plastic such as polytetrafluoroethylene. Other materials which meet these two requirements may, of course, be substituted.

The diameter of the shaft 66 is such that it is freely slideable within the bore 42. At the bottom of the shaft 66 is an enlarged portion 70 which is surmounted by a slightly enlarged portion 72 having a diameter greater than that of the shaft 66, but smaller than that of the enlargement 70. The upper portion of the shaft 66 is annularly reduced as at 74.

Rigidly mounted to the toroidal enlargement 72 is a washer-like, toroidal armature 78 made of a ferromagnetic material. A central hole 80 of the armature 78 is fitted over the enlargement 72 and the armature 78 is fixed thereon by any convenient method, for example, by a force fit or an adhesive.

Carried loosely on the upper shaft 66 is a toroidal permanent magnet 82. The central hole 84 through the magnet 82 is sufficiently larger than the shaft 66 both to permit the magnet 82 to freely move on the shaft 66 and to permit "cocking" of the magnet 82 (i.e., where the major axes of the magnet 82 and the plunger 68 do not coincide) as shown in FIG. 5. Preferably, the top and bottom surfaces of the magnet 82 are generally planar and are designed for a flush fit against the lower planar surface of the mounting member 40 and the upper planar surface of the armature 78.

Adhesively or otherwise held in a recess 85 on the lower end of the plunger 68 is a resilient bumper 86 which conveniently may comprise sponge rubber of similar material.

Preferably, but not necessarily, mounted on the shaft 66 is a non magnet washer 87 made of a plastic or the like material. The diameter of the hole in the washer 87 is about the same as that of the hole 84 in the magnet 82 to permit free movement on the shaft 66 and "cocking" as shown in FIG. 5.

The washer 87 serves a purpose described below and may be mounted on the shaft 66 either above or below the magnet 82, the latter being preferred and depicted in FIGS. 1, 2 and 5.

In assembling the plunger 68 and the member 40, and referring to the right-hand side of FIG. 2, the bumper 86 is attached to the lower end of the plunger 68 in the recess 85. The armature 78 is force fit or clockwise attached to the enlargement 72 and the washer 87 and the magnet 82 are placed over the shaft 66. The upper end of the rod 68 is now passed through the bore 42 of the member 40. After passage of the reduced portion 74 beyond the top of the tubular member 62, a retaining washer 88 is force fit onto the reduced portion 74. The outer diameter of the washer 88 is greater than the diameter of the bore 42 in the tubular member 62. Moreover, the diameter of the armature 78 is greater than the diameter of the bore 42. Accordingly, the entire assembly is retained for sliding motion in the member 40.

The assembly just described may be mounted by the member 40, as previously described, to the keyboard 12, FIG. 1. Such mounting positions the resilient bumper 86 of each switch 10 in line with one of the movable contacts 36 on the printed circuit board 22. Conveniently, this mounting of each switch 10 to the keyboard 12 awaits the assembly of the remainder of the switch 10 shown in the left-hand side of FIG. 2.

The upper portion of each switch 10 includes a generally tubular member or hollow cylinder 90, having a central bore 92 which is opened at the lower end of the cylinder 90 and closed at the upper end. The cylinder 90 is preferably made of a molded plastic.

The outer diameter of the cylinder 90 is such that the cylinder freely slides within the bore 18 in the vertical member 16 of the keyboard 12. Formed at diametrically opposed positions on the outer surface of the cylinder 90 are a pair of generally elongated guide flanges 94 which are parallel to the major axis of the cylinder 90. The flanges 94 are designed to interfit and be journalled in a pair of diametrically opposed grooves 96 formed in the inner upper wall of the bore 18. Such journalling prevents rotation of and ensures longitudinal movement of the cylinder 90 during operation of the switch 10.

The outside upper end of the cylinder 90 carries a generally cruciform locking member 98. The locking member 98 frictionally interfits with a cruciform opening 100 formed in the underside of a finger-engageable button or key 102 for attaching the button 102 to the top of the cylinder 90. The button 102 contains a generally annular depression in its under side 104 which, as best shown in FIG. 1, is so formed that during movement of the button 102 toward the keyboard 12, the vertical member 16 of the keyboard 12 is cleared thereby. The lower outside end of the cylinder 90 carries an annular enlargement 106 having a diameter greater than the diameter of the cylinder 90 and being approximately equal to the diameter of the enlarged opening 24 of the aperture 18 defined by and below the step 20.

The step 20 and an upper surface 110 of the enlargement 106 are designed to be engageable so that upward movement of the cylinder 90 is limited thereby as best shown at the left of FIG. 1. A lower surface 112 of the enlargement 106 is designed to engage the upper surface 64 of the mounting member 40. Thus, downward movement of the cylinder 90 within the bore 18 is limited by engagement of these latter two surfaces 64 and 112. Specifically, such limitation is effected so that downward movement of the cylinder 90 is prevented before the upper surfaces of the vertical member 16 engages the bottom side of the button 102 within the annular depression 104. The central bore 92 of the cylinders 90 is enlarged at its lower end as at 116. The enlargement 116 is so formed as to permit entry thereinto of the tubular member 62 on the mounting member 40.

The junction of the upper central bore 92 and the enlargement 116 thereof defines a step 118. The step is designed to engage the top of the washer 88 as a "fail-safe" measure in the event of improper operation of the switch 10, as described below. It should be noted that in the unoperated position (right and left sides of FIG. 1) the distance from the step 118 to the washer 88 is less than the distance of the bottom surface 112 of the enlargement 106 from the top 64 of the portion 44 of the toroid 40.

Contained within the bore 92 are one or more coil springs 120 and 122. A lower end of the coil spring 120 is so formed as to fit about the angularly reduced portion 74 above the washer 88. This fit may be effected frictionally or by any other convenient method. The upper end of the coil spring 118 normally engages and lightly bears against the closed end of the cylinder 90.

The spring 122 is much stronger than and fits inside the spring 120. Moreover, the spring 122 is wound in a direction opposite that of the spring 120 so that the coils of each spring do not interfere with each other. The spring 122 is shorter than the spring 120 and normally does not touch the closed end of the cylinder 90, but rests on the top of the reduction 74.

Returning to FIG. 2, the assembly of the entire switch 10 can now be seen to first involve the assembly of the component parts shown at the right-hand side. Subsequently, the spring 120 is fitted around the annularly reduced portion 74 and the spring 122 is placed within the spring 120. The cylinder 90 is placed over both springs. The entire assembly is then inserted into the aperture 18 from the bottom of the keyboard 12 until the mounting member 40 is positioned within the lower portion of the bore 18 as described previously. The mounting member 40 is then rotated, as previously described, to lock the entire assembly within the keyboard surface 12. Subsequently, the button 102 is affixed to the locking member 98 on the cylinder 90.

In the normally unactuated position shown at the extreme left and right of FIG. 1, the length of the coil spring 120 is such that it pushes against both the closed end of the cylinder 90 and the top of the shaft 66 lightly biasing them apart. The annular enlargement 106 of the cylinder 90 prevents that cylinder from being pushed out of the aperture 18. Furthermore, the length of the coil spring 120 is such that in the normally unoperated position only a slight force is exerted on the plunger 68. Accordingly, the leaf spring 34 of the movable contact 36 maintains its normal position spacing the contact 36 away from the fixed contact 38. Preferably, in this normally unactuated position, the resilient button 86 lightly rests on the leaf spring 34 immediately above the movable contact 36. As previously noted, upward movement of the cylinder 90 is limited by the cooperation of the annular enlargement 106 and the step 20.

OPERATION

In the operation of the switch 10, a force designated by the numeral 124 in FIG. 1, is applied to the top surface of the button 102 by an operator. Application of such force moves the cylinder 90 downwardly in the aperture 18, first compressing the coil spring 120.

Further movement of the cylinder 90 contacts the closed end thereof with the stronger spring 122, at which time the operator senses greater resistance to movement. The difference in resistance sensed by the operator in first compressing the washer spring 120 and then compressing both springs 120 and 122 gives the switch a good "feel." Specifically, the operator knows that unless the greater resistance is felt, the switch cannot have effected engagement of the contacts 36 and 38.

Further downward movement of the cylinder 90 and compression of the springs 120 and 122 continue until such time as there is sufficient potential energy stored in the springs 120 and 122 to break the interfacial contact (due to magnetic attraction) of the magnet 82 with either the mounting member 40 or the armature 78. Note that in this first described embodiment it is not important which interface is broken. Specifically, either the magnet/mounting member interface of the magnet/armature interface may be broken. This is the reason that the central hole 84 of the magnet 82 is made sufficiently large to permit the magnet to slide freely on the shaft 66.

Specifically, as shown in FIG. 5, the magnet 82 may well be attracted at one side to the mounting member 40 and at the other side to the armature 78 after the interfaces are broken because the plunger 68 has moved downwardly. Thus, the central hole 84 of the magnet 82 is sufficiently large to permit this cocked or skewed orientation. A further advantage is realized due to the size of the hole 84 because upon return of the plunger 68 to its normal position, as described subsequently, the magnet 82 exhibits a self-aligning characteristic. Specifically, because of the size of the hole 84, the magnet 82 freely assumes its normally plane-to-plane contact with both the member 40 and the armature 78 as best shown at the left and right sides of FIG. 1.

If it is desired to maintain the magnet 82 in a given position during operation of the switch 10, the washer 87 may be used. Preferably, the washer is located on the lower side of the magnet 82 to provide a "built-in" gap between the top of the armature 78 and the bottom of the magnet 82. Because of this gap and the fact that the magnetic attraction decreases roughly proportionally to the square of the width of this gap, the magnetic attraction of the magnet 82 for the armature 78 is slightly less than its attraction for the mounting member 40. Thus, as shown in the middle of FIG. 1, downward motion of the plunger 68 leaves the magnet 82 in a planar abutting relationship with the member 40 and the skewing of FIG. 5 does not usually occur. Of course, should the magnet 82 by happenstance remain partially or wholly attracted to the armature 78 during downward movement of the plunger 68, the self-aligning feature of the magnet 82 due to the size of a central bore 84 again comes into play, as described above.

Similar comments apply when the washer 87 is interposed between the magnet 82 and the member 40, except that the magnet 82 will move down with the armature 78 as the plunger 68 moves down.

If for some reason the potential energy in the springs 120, 122 is unable to break one of the interfaces 82/40 or 82/78, whether or not the washer 87 is used, continued downward movement of the cylinder 90 causes contact of the washer 88 by the step 118. The direct coupling of the force 124 to the plunger 68 breaks one of the interfaces 82/40 or 82/78. Such inability is postulated to be due to temporary magnetization of the member 40 and the armature 78 by the magnet 82 during long periods of non use of the switch 10. It has been found that after several cycles of use where the step 118 effects movement of the plunger 68, such residual magnetization disappears and the more usual operation of the switch 10 obtains thereafter.

As noted previously, the storage of sufficient potential energy in the coil springs 120 and 122 causes the interface due to magnetic attraction between magnet 82 and either the member 40 or the armature 78 to be suddenly broken. It is the sudden breaking of this magnetic attraction which provides the snap-action and tactile feedback of the switch 10 of the present invention. A similar snap-action occurs when plunger movement is effected by the step 118, although the "feel" thereof differs slightly from the usual tactile feedback.

Upon the sudden breaking of the interface due to magnetic attraction, the potential energy stored to the springs 120 and 122 impels the plunger 68 downwardly. Such impelling forces the resilient button 86 against the leaf spring 34 and moves the movable contact 36 into engagement with the stationary contact 38. Immediately after the breaking of one of the interfaces (or both of them) downward movement of the cylinder 90 continues. Such continued downward movement continues to urge the coil springs 120 and 124 against the top of the plunger 68. Such movement of the cylinder 90 continues until the annular enlargement 106 engages the top of the mounting member 40. This is an important feature to note — finger force is prevented from ever being applied to the movable contact 36 and the stationary contact 38. Specifically, because the annular enlargement 106 engages the top of the mounting member 40 and because the only direct coupling between the cylinder 90 and the shaft 66 are the coil springs 120 and 122, the maximum force that may be exerted on the contacts 36 and 38 is that force due to the stored potential energy in the coil springs 120 and 122 when the cylinder 90 is fully down, as shown in the middle of FIG. 1.

Note that, when the plunger 68 is fully down, the step 118 is spaced from the washer 88.

The resilient bumper 86 is effective to prevent contact "bounce" during closure of the contacts 36-38. Specifically, the button 86 acts as a damper or shock absorber for the movable contact 36, obviating any tendency thereof to rebound away from the stationary contact 38.

Such bounce is also eliminated by the action of the springs 34, 120 and 122 which lead to maintain the contacts 36 and 38 in engagement.

After the sudden break in the magnetic attraction of the magnet 82 to either the armature 78 or the member 40, the magnetic attraction of the magnet-armature-member 82-78-40 remains, albeit diminished. Such attraction leads to limit the velocity of the plunger 68. Moreover, after the break, the movement of the plunger 68 is effected by the springs 120 and 122 acting against the spring 34, i.e., "spring-versus-spring." The result is a smooth switch action accompanied by an absence of contact bounce and good tactile feedback.

As long as the button 102 is held in the downward position, the contacts 34-36 remain closed and the coil springs 120 and 122 are compressed. Subsequent removal of the force 124 effects the following sequence of operation.

The stored potential energy in the coil springs 120 and 122 urging against the closed end of the cylinder 90 moves the button 102 and the cylinder 90, now upwardly. Simultaneously, the potential energy now stored in the leaf spring 34 and the magnetic attraction between the armature 78 and the magnet 82 cooperate to move the plunger 68 upwardly. Upward movement of the plunger 68 continues until the plunger 68 is in its normal position. The coil springs 120 and 122 return the cylinder 90 and the button 102 to their normal positions.

The switch 10 may be constructed so that the stored potential energy in the leaf spring 34 is not necessary to return the plunger 68 to its normal position. Specifically the thickness and maximum separation of the magnet 82, the armature 78 and the member 40 may all be adjusted so that the return is due solely to magnetic attraction. Of course, any compression of the bumper 86 may be utilized to effect such return.

As may be appreciated, the self-lubricating feature of the plunger 68 insures that this rod slides freely within the bore 42 and the mounting member 40. The non-magnetic characteristic of the plunger 68 prevents the magnet 82 from "sticking" thereto during operation. Such sticking would obviate the desirable self-aligning features of the magnet 82 and could adversely affect return of the switch to its normal position.

In view of the foregoing, it is apparent that various modifications may be made to the present illustrative embodiments of the invention, and that a number of alternatives may be provided without departing from the spirit and scope of the invention.

What is claimed is:

1. An improved snap-action driver of the type which selectively moves a spring-biased workpiece from a first, normal position to a second position against the spring-bias by the urging of one end of an elongated plunger thereagainst due to the plunger's moving out of its normal position in response to a first force applied to the other end thereof, wherein the improvement comprises:

a. a stationary, ferromagnetic member having a bore slideably mounting the plunger;

b. a ferromagnetic armature fixed to the plunger for movement therewith;

c. a permanent magnet slideably mounted on the plunger, the magnet being normally attracted to, and abutting at respective interfaces, the member and the armature in a sandwich to maintain the plunger in its normal position; and d. means for storing potential energy in response to the application of a gradually increasing second force thereto and for applying the stored energy in the force of the first force to the other plunger end until the magnetic attraction of the magnet is exceeded, and for then moving the one plunger end against the workpiece to move the workpiece to the second position; and wherein the plunger is non-magnetic.

2. The driver of claim 1, which further includes:

e. means for rendering the magnetic attraction of the magnet for the member different from the attraction thereof for the armature.

3. The driver of claim 2 wherein element (d) comprises:

$d_1$. a hollow cylinder closed at one end and movable toward and away from the plunger along the major axes thereof; and $d_2$. a first coil spring contained within the cylinder and normally abutting and urging apart the closed cylinder and the plunger, movement of the cylinder toward the plunger in response to the application of the second force thereto storing the potential energy therein by compression thereof.

4. The driver of claim 3 wherein element (e) comprises:

$e_1$. a nonmagnetic member slideably mounted on the plunger between one of the interfaces.

5. The driver of claim 4, adapted to be mounted in a surface, which further comprises:

f. means for locking the ferromagnetic member to the surface;

g. means for slideably mounting the cylinder for movement;

h. means for limiting the movement of the cylinder toward the plunger to prevent contact between the cylinder and the plunger; and i. means for limiting the movement of the cylinder away from the plunger and for maintaining the coil spring within the cylinder to normally urge apart the closed end of the plunger.

6. The driver of claim 5 wherein element (d) further comprises:

$d_3$. a second coil spring contained within the first coil spring, the second spring being normally fully extended within the cylinder and being shorter than the first spring, a predetermined amount of movement of the cylinder toward the plunger effecting compression thereof, the stored potential energy thereafter resulting from the compression of the first and second springs.

7. The driver of claim 6 which further comprises:

j. means for limiting movement of the plunger within the ferromagnetic member to prevent either plunger end from moving beyond such manner.

8. The driver of claim 7 used to affect the operation of electrical circuit by movement of the workpiece and adapted for mounting in a keyboard constituting the surface, and having a hole therethrough wherein:

the locking means (f) comprises an enlargement of the ferromagnetic member driveable into the walls of the keyboard hole;

the magnet, the armature and the ferromagnetic member are all generally toroidal and have planar surfaces at which the interfaces are located;

the cylinder moves in the keyboard hole and the slideable cylinder mounting means (g) comprises a flange on the cylinder journalled in a groove in the wall of the cylinder hole;

elements (h) and (i) respectively comprise an enlargement on the cylinder engageable respectively with the ferromagnetic member and step within the keyboard hole; and element (j) comprises a collar at the other plunger end and a planar surface of the armature, both being larger than the bore in the ferromagnetic member.

9. The driver of claim 8 which further includes:

k. a resilient member interposed between the one plunger end and the workpiece.

10. The driver of claim 9 wherein the workpiece is a first electrical contact, and further comprising:

l. a second electrical contact engaged by the first contact at the second position; and m. a leaf spring for biasing the first contact into the first position.

11. A snap-action actuator, which comprises:

a fixed support having a ferromagnetic insert;

a plunger reciprocably mounted in the support for movement from a first position toward a second position, the plunger having a ferromagnetic armature;

a magnet movably mounted in the support between the insert and the armature so that, absent a force applied to the plunger, the magnet attracts both the insert and the armature to form a sandwich, which sets the first plunger position; and means for applying a gradually increasing force to one end of the plunger until the magnetic attractive force forming the sandwich is exceeded, to suddenly drive the plunger to the second position, with a snap action after the magnetic release point.

12. The actuator of claim 11 wherein:

the plunger is nonmagnetic;

the insert, the magnet and the armature all contain a bore which receives the plunger, the armature being fixed to the plunger in its bore, the bores of the insert and the magnet being such that both are free to move relatively to the plunger; and the means comprises a spring for storing potential energy therein and applying such energy to the one plunger end in the form of the gradually increasing force.

13. A force-operated, snap-action switch for mounting in a keyboard comprising:

a. a ferromagnetic toroid b. means for fixedly mounting the toroid to the keyboard;

c. a nonmagnetic elongated plunger slideably held by, and extending past both ends of, the toroid;

d. a toroidal permanent magnet loosely, slideably mounted on the plunger on one side of the toroid, one surface of the magnet normally abutting the toroid;

e. a toroidal armature mounted on the plunger, the other surface of the magnet normally abutting the armature;

f. means for rendering the attractive force of the magnet for the toroid greater than the attractive force thereof for the armature;

g. a first, stationary electrical contact, spaced from one end of the plunger and aligned with the plunger's major axis at the side thereof adjacent the armature;

h. a second electrical contact movable along the major axis of the plunger and located between the normally spaced from the first contact and the one plunger end;

i. a spring member for maintaining the second contact in the normal position;

j. a hollow cylinder open at only one end having its open end loosely slideably fitted about the other end of the plunger and normally spaced from the toroid;

k. a coil spring positioned between the closed cylinder end and the other plunger end which maintains the open cylinder end in the normal position; and l. means responsive to a force applied to the cylinder for moving the open cylinder end toward the toroid to compress the coil spring until the compressive force thereon on the plunger overcomes the attractive force of the magnet to impact the plunger on the second contact with a force sufficient to deform the spring member until the contacts engage the spring member and the attractive force of the magnet for the armature returning the armature to its normal position and the coil spring returning the cylinder to its normal position upon removal of the force.

14. A keyboard-mounted snap-action electrical switch for completing an electrical circuit comprising:

a. a first stationary electrical contact;

b. a second electrical contact normally spaced from and movable into engagement with, the first contact to complete the circuit;

c. first spring means for biasing the second contact toward its normal position with a first force inversely proportional to the distance between the contacts; and d. means for moving the second contact into engagement with the first contact, which means includes:

i. a ferromagnetic toroid;

ii. means for fixedly mounting the toroid to the keyboard;

iii. a non-magnetic plunger extending slideably through, and beyond both sides of the toroid, a first end of the plunger abutting the second contact, application of a second force to the other end of the plunger tending to move the contacts into engagement;

iv. a toroidal, ferromagnetic armature mounted on the plunger for movement therewith;

v. a toroidal, permanent magnet slideably mounted on the plunger between the toroid and the armature, opposed surfaces thereof being normally respectively adjacent the toroid and the armature;

vi. means for rendering the attractive force of the magnet for the toroid greater than the attractive force thereof for the armature, so that movement of the first plunger end toward and away from the first contact moves the armature toward and away from the toroid and the magnet, the attractive force of the magnet for the armature and the first force being vectorially additive, the summation of such vectorial addition being normally greater than the second force and the attractive force of the magnet for the armature being inversely proportional to the distance between the armature and the magnet; and vii. means responsive to a finger-applied force for momentarily increasing the second force to a magnitude greater than the summation to slide the plunger and to move the armature and the second contact toward the first contact until engagement thereof occurs.

15. The switch of claim 14 wherein element (d) (vii) comprises:

$vii_1$. a hollow cylinder open at only one end having its open end loosely, slideably fitted about the other plunger end and normally spaced from the toroid, the cylinder being movable toward the toroid in response to the application of a force in the direction of the first contact to the closed end thereof; and $vii_2$. coil spring means within the cylinder and positioned between the closed cylinder end and the other plunger end for (i) maintaining the open cylinder end in the normal position, and, (ii) applying the second force to the other plunger end in response to a predetermined amount of movement of the cylinder toward the toroid.

* * * * *

UNITED STATES PATENT OFFICE
CERTIFICATE OF CORRECTION

PATENT NO. : 3,942,145
DATED : March 2, 1976
INVENTOR(S) : BERNARD J. SOBCZAK

It is certified that error appears in the above-identified patent and that said Letters Patent are hereby corrected as shown below:

Column 8, line 52, change "desired" to --desirable--.

Column 11, line 35, delete "of" and insert --and--.

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*